US006372343B1

(12) United States Patent
Yamada et al.

(10) Patent No.: US 6,372,343 B1
(45) Date of Patent: Apr. 16, 2002

(54) CRIMPED POLYESTER FIBER AND FIBROUS STRUCTURE COMPRISING THE SAME

(75) Inventors: Toshihiro Yamada; Mikio Tashiro; Ryoji Tsukamoto, all of Matsuyama; Kenji Baba, Osaka, all of (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/890,960

(22) PCT Filed: Dec. 28, 2000

(86) PCT No.: PCT/JP00/09399

§ 371 Date: Aug. 8, 2001

§ 102(e) Date: Aug. 8, 2001

(87) PCT Pub. No.: WO01/49909

PCT Pub. Date: Jul. 12, 2001

(30) Foreign Application Priority Data

Jan. 7, 2000 (JP) ..... 2000-1865
Feb. 9, 2000 (JP) ..... 2000-31813

(51) Int. Cl.[7] ..... D01C 6/00

(52) U.S. Cl. ..... 428/362; 428/364; 428/376; 428/398; 428/395

(58) Field of Search ..... 428/364, 362, 428/369, 376, 395, 398, 373

(56) References Cited

U.S. PATENT DOCUMENTS 3,940,543 A * 2/1976 Chimura et al. ..... 428/373
3,988,387 A * 10/1976 Chimura et al. ..... 260/86 C
5,858,528 A * 1/1999 Tashiro et al. ..... 428/357
5,882,780 A * 3/1999 Yamamura et al. ..... 428/229
5,997,980 A * 12/1999 Matoba et al. ..... 428/376
6,242,091 B1 * 6/2001 Howel et al. ..... 428/364
6,306,499 B1 * 10/2001 Ochi ..... 428/364

FOREIGN PATENT DOCUMENTS

| | | |
|---|---|---|
| JP | 62-299540 | 12/1987 |
| JP | A 04-240219 | 8/1992 |
| JP | 08-188918 | 7/1996 |
| JP | 411081120 A * | 3/1999 |
| JP | 11-189920 | 7/1999 |
| JP | A 11-189938 | 7/1999 |
| WO | WO 91/19032 | 12/1991 |
| WO | 96/00808 | 1/1996 |

* cited by examiner

*Primary Examiner*—N. Edwards
(74) *Attorney, Agent, or Firm*—Sughrue Mion, PLLC

(57) ABSTRACT

Crimped polyester fibers which comprise a polytrimethylene terephthalate-based polyester and have three-dimensional crimps with a number of crimps of 9 to 30 peaks/25 mm and a crimp ratio of 20 to 50% and further a crimp modulus of elasticity of 80% or above. A fiber structure wherein the weight ratio of staple fibers of the above crimped polyester fibers to heat-bonding conjugated staple fibers is 30:70 to 95:5 and heat-bonded spots are formed at least partially in contact points of both the staple fibers and/or contact points of the mutual heat-bonding conjugated staple fibers.

5 Claims, No Drawings

CRIMPED POLYESTER FIBER AND FIBROUS STRUCTURE COMPRISING THE SAME

TECHNICAL FIELD

This invention relates to polyester fibers having three-dimensional crimps and a fiber structure using the same, and more particularly it relates to crimped polyester fiber good in carding performance and capable of providing products rich in bulkiness and good in compression durability such as nonwoven fabrics or waddings and a fiber structure comprising said crimped polyester fibers and heat-bonding conjugated staple fibers.

BACKGROUND OF THE INVENTION

Polyester fibers, especially polyethylene terephthalate fibers are excellent in mechanical strength and chemical and heat resistances or the like and have widely been used for applications such as clothes or industrial uses. The polyethylene terephthalate fibers themselves, however, are flat and deficient in bulkiness. Various attempts to improve the bulkiness, therefore, have been made in uses such as the nonwoven fabrics or waddings requiring a bulky feeling by crimping the polyethylene terephthalate fibers.

Although the above products produced from the crimped polyethylene terephthalate fibers have high bulkiness just after the use, there are problems that disappearance of compression durability is readily caused when used for a long period.

In contrast to this, JP-A No. 11-189938 (1999) (hereunder, JP-A means Japanese unexamined patent publication) proposes polytrimethylene terephthalate staple fibers having crimps in which stretch elastic recovery ratio, flexing recovery ratio and the like are specified, and such staple fibers are improved in compression durability as compared with that of crimped fibers comprising polyethylene terephthalate. Said staple fibers, however, are produced by a method of heat-treating the polytrimethylene terephthalate fibers, then carrying out crimping with a stuffer crimper and cutting the crimped fibers into the staple fibers, and there are problems that the staple fibers have merely planar, the so-called two-dimensional crimps and the bulkiness of the products obtained from said fibers is insufficient. Furthermore, U.S. Pat. No. 3,681,188 proposes fibers produced by imparting asymmetric birefringence across filament diameters to extruded filaments of polytrimethylene terephthalate by asymmetric quenching and developing three-dimensional crimps. The crimped fibers obtained by the methods disclosed in the prior art, however, have an extremely small number of crimps or an excessively high percentage crimp, and there are problems that only products insufficient in bulkiness or compression durability are obtained from such crimped fibers and winding up of a web around cylinders or rollers, waste fibers, web breakage and the like are caused in a carding step.

On the other hand, polyester staple fibers, especially polyethylene terephthalate (hereinafter sometimes abbreviated to PET)-based staple fibers have hitherto been extensively used as wadding materials for beddings, furniture, clothes or the like. Above all, a fiber structure obtained by mixing such polyester staple fibers with heat-bonding conjugated fibers and heat-treating the mixed fibers is utilized as a urethane substitute material for various applications such as cushioning materials, padding materials of futons, automotive sheets or bed mats. International Application Published under the Patent Cooperation Treaty WO91/19032, JP-A No. 4-240219 (1992) and the like are proposed as fiber structures obtained by using the above heat-bonding conjugated fibers; however, there has been a demand for such fiber structure to further improve the compression durability.

DISCLOSURE OF THE INVENTION

As a result of intensive investigations made to achieve the above problems, the present inventors et al. have found that not only the carding performance is improved but also bulkiness and compression durability of the resulting products are remarkably improved when using crimped polyester fibers comprising polytrimethylene terephthalate and having moderate three-dimensional crimps and a high crimp modulus of elasticity, thus accomplishing the present invention. Furthermore, it has been found that the bulkiness and compression durability are remarkably improved as compared with those of conventionally proposed fiber structures when combining the above crimped polyester fibers with heat-bonding conjugated fibers and providing a fiber structure.

Thereby, according to this invention, there are proposed crimped polyester fibers characterized as comprising a polytrimethylene terephthalate-based polyester and having three-dimensional crimps with a number of crimps of 9 to 30 peaks/25 mm and a crimp ratio of 20 to 50% and further a crimp modulus of elasticity of 80% or above and a fiber structure characterized as comprising staple fibers of the above crimped polyester fibers and heat-bonding conjugated staple fibers in a weight ratio of the staple fibers of said crimped polyester fibers to said heat-bonding conjugated staple fibers of 30:70 to 95:5 and having heat-bonded spots formed at least partially in contact points of the staple fibers of said crimped polyester fibers with said heat-bonding conjugated staple fibers and/or contact points of the mutual heat-bonding conjugated staple fibers.

BEST MODE FOR CARRYING OUT THE INVENTION

The polytrimethylene terephthalate based polyester described in this invention is a polyester comprising a trimethylene terephthalate unit as a main recurring unit and may be a polyester wherein a third component in an amount within the range so as not to inhibit the object of this invention, for example, 15 mole % or less, perferably 5 mole % or less based on an acid component is copolymerized.

Various kinds such as an acid component, for example, isophthalic acid, succinic acid, adipic acid, 2,6-naphthalenedicarboxylic acid or a metal sulfoisophthalic acid and a glycol component or the like, for example, 1,4-butanediol, 1,6-hexanediol, cyclohexanediol or cyclohexanedimethanol can be used as the preferably used third component and may suitably be used by taking the spinning property or the like into consideration.

Various additives, for example, a delustering agent, a heat stabilizer, a defoaming agent, an orthochromatic agent, a flame retardant, an antioxidant, an ultraviolet absorber, an infrared absorber, a fluorescent brightener or a color pigment, as necessary, can be added.

In this invention, it is important that not only the crimped polyester fibers of this invention are crimped fibers comprising the above polytrimethylene terephthalate-based polyester but also said fibers have three-dimensional crimps satisfying the number of crimps and crimp ratio described below and the crimp modulus of elasticity simultaneously satisfying the following requirements. Thus, products good in carding performance and excellent in bulkiness and compression durability can be obtained.

That is, the number of crimps of the crimped polyester fibers of t is invention must be 9 to 30 peaks/25 mm and is more preferably 11 to 20 peaks/25 mm. When the number of crimps is below 9 peaks/25 mm, the bulkiness of products obtained from said fibers is insufficient. On the other hand, when the number of crimps exceeds 30 peaks/25 mm, the entangling property among the fibers becomes too high and the carding performance is deteriorated.

The crimp ratio of said polyester fibers must be 20 to 50% and is more preferably 30 to 40%. When said crimp ratio is below 20%, the entangling property among the mutual fibers is low, the carding performance is deteriorated, and sufficient bulkiness cannot be obtained. On the other hand, when the crimp ratio exceeds 50%, not only the entangling property becomes so high that tangling is caused to deteriorate the carding performance but also the resulting web becomes nonuniform.

Further, the crimp modulus of elasticity of said polyester fibers must be 80% or above and is more preferably 85% or above. When the crimp modulus of elasticity is below 80%, the carding performance is extremely deteriorated because the disappearance of compression durability of crimps is great, and the fibers are easily wound up around cylinders or rollers to produce much waste fibers and cause web breakage and the like. As a result, the productivity is extremely lowered, and the bulkiness of the resulting products is insufficient. The compression durability of said products is extremely lowered at the same time. Since the polytrimethylene terephthalate-based polyester fibers especially have a lower modulus and a lower crystallinity than those of polyethylene terephthalate fibers, the disappearance of compression durability of crimps tends to occur. Accordingly, it is important to specify the crimp modulus of elasticity as described above.

In this invention, the carding performance can be improved and the bulkiness and compression durability of the products can be improved in cooperation of the above effects by simultaneously making the crimped polyester fibers satisfy the requirements of percentage crimp, crimp ratio and crimp modulus of elasticity as described above.

Moreover, such effects become more marked by crimps which are the three-dimensional crimps imparted to said polyester fibers. Because of this, sufficient effects cannot be obtained from such crimps which are planar crimps imparted by a method such as crimping with a stuffing crimper or the like.

The crimped polyester fibers of this invention include fibers obtained by forming polytrimethylene terephthalate polymers different in viscosity into fibers conjugated in the side-by-side type or the eccentric core-sheath type, heat-treating the resulting conjugated fibers and developing crimps or fibers produced by carrying out asymmetric quenching in a spinning step, heat-treating the resulting fibers and then developing the crimps or the like. In this invention, the crimped polyester fibers are especially preferably the latter fibers wherein the crimps are developed by the asymmetric quenching. The above crimps cause extremely slight disappearance of compression durability of crimps even when the fibers are packed into a bale-like form, by applying a compression pressure and allowed to stand for a long period as opposed to mechanical crimps imparted by stuffer crimping with a crimper or the like, and processability is excellent without causing the winding up of the fibers around cylinders or rollers, waste fibers, web breakage and the like even when the fibers are then subjected to the carding step.

The single fiber cross-sectional shape of the crimped polyester fibers of this invention is not especially limited, and a circular form, a triangular form, a flat form, a hexagonal form or the like may suitably be selected according to the purpose of uses. In this invention, the above fibers are more preferably hollow fibers having especially a percentage of hollowness of 5 to 80% from the viewpoint of easy impartment of the asymmetric birefringence across their diameters in the spinning step and easy development of the three-dimensional crimps.

The crimped polyester fibers of this invention described above can be produced by, for example, the following method:

That is, a polytrimethylene terephthalate polymer is melted and a quench air stream having a flow velocity of 1.0 m/s or above is blown from one side of filaments just after discharging from a spinneret surface at an angle within the range of ±20 degrees in the perpendicular-direction from the forward direction of the filaments on the filaments to take off the resulting filaments at 350 to 2,500 m/min. Thereby, an undrawn yarn having a high level of the asymmetric birefringence across the filament diameters in the degree of birefringence is obtained. Said undrawn yarn is then drawn in hot water at 50 to 95° C. at 1.2 to 3.5 times, more preferably in two stages, subsequently cut into staple fibers without carrying out heat treatment at a constant length and heat-treated at 100 to 150° C. under relaxed conditions. At this time, the flow velocity of the quench air stream can be regulated to 1.0 m/s or above to thereby impart the high level of the asymmetric birefringence across the filament diameters and easily and favorably develop the three-dimensional crimps with a number of crimps of 9 or above. The direction of the quench air stream blown from one side of the filaments is especially preferably regulated to ±20 degrees in the perpendicular direction from the forward direction of the filaments from the viewpoint that the spinning performance can thereby be improved and the asymmetric birefringence across their diameters can easily be imparted. As described above, the cut length is preferably within the range of 10 to 100 mm, especially preferably within the range of 15 to 90 mm when the crimped polyester fibers of this invention are cut into the staple fibers. The resulting crimped staple fibers can be subjected to carding, and processing required for the respective products can then be performed to provide nonwoven fabrics, waddings, cushioning materials or the like good in bulkiness and compression durability.

For example, the fiber structure comprising the staple fibers of the crimped polyester fibers of this invention and the heat-bonding conjugated fibers described below in a weight ratio thereof of 30:70 to 95:5, preferably 40:60 to 90:10 and having heat-bonded spots formed at least partially in contact points of the staple fibers of said crimped polyester fibers with said heat-bonding conjugated staple fibers and/or contact points of the mutual heat-bonding conjugated staple fibers can be provided to thereby afford waddings, cushioning materials or the like remarkably improved in bulkiness and compression durability. The fibers forming the skeleton of the above fiber structure are the above crimped polyester fibers to thereby provide a fiber structure remarkably improved in compression durability as compared with that of a conventional fiber structure comprising heat-bonding staple fibers alone or the heat-bonding staple fibers and polyethylene terephthalate-based polyester staple fibers.

The above heat-bonding conjugated staple fibers are preferably polyester-based conjugated fibers obtained by arranging a thermoplastic polyester-based elastomer (E) and a polyester (P) having a higher melting point than that of said elastomer by 10° C. or more in an area ratio E:p of 20:80 to 80:20 in the fiber cross section so as to expose at least a part of said elastomer (E) to the fiber surface. The combination of such fibers with the crimped polyester fibers of this invention provides better elasticity and improves compression durability.

Meanwhile, a polyetherester-based block copolymer comprising a polyester as a hard segment and a poly(alkylene oxide)glycol as a soft segment is preferred as the above thermoplastic polyester-based elastomer (E). A polyester comprising at least one kind of dicarboxylic acid selected from an aromatic dicarboxylic acid such as terephthalic acid, isophthalic acid, naphthalene-2,6-dicarboxylic acid, naphthalene-2,7-dicarboxylic acid, diphenyl-4,4'-dicarboxylic acid, diphenoxyethanedicarboxylic acid or 5-sodium sulfoisophthalic acid, an alicyclic dicarboxylic acid such as 1,4-cyclohexanedicarboxylic acid, an aliphatic dicarboxylic acid or the like such as succinic acid, oxalic acid, adipic acid, sebacic acid, dodecanoic acid or dimer acid and at least one kind of diol component selected from an aliphatic diol such as ethylene glycol, diethylene glycol, trimethylene glycol, tetramethylene glycol, pentamethylene glycol, hexamethylene glycol, neopentyl glycol or decamethylene glycol or an alicyclic diol or the like such as 1,1-cyclohexanedimethanol or tricyclodecanedimethanol is exemplified as the above hard segment. A poly(alkylene oxide)glycol such as polyethylene glycol, poly(1,2-propylene oxide)glycol, poly(tetramethylene oxide)glycol, poly(trimethylene oxide)glycol, a copolymer of ethylene oxide and propylene oxide or a copolymer of ethylene oxide and tetrahydrofuran having an average molecular weight of about 400 to 5,000 can be cited as the soft segment.

In particular, the thermoplastic polyester-based elastomer (E) is preferably a polyetherester-based block copolymer comprising a hard segment component which is a polyester comprising a main acid component of 40 to 100 mole % of terephthalic acid and 0 to 50 mole % of isophthalic acid and a main glycol component of 1,4-butanediol and a main soft segment component which is a poly(alkylene oxide)glycol having an average molecular weight of 400 to 5,000 in a copolymerization ratio (weight ratio) of said hard segment component to said soft segment component of 95:5 to 20:80% by weight.

The above thermoplastic polyester-based elastomer (E) has a melting point within the range of 100 to 210° C., more preferably within the range of 130 to 180° C. When the melting point is within the range, the occurrence of fusion or contact bonding of mutual fibers when producing the heat-bonding conjugated fibers is further suppressed and the unevenness of bonding when producing the fiber structure is further suppressed. Furthermore, the intrinsic viscosity of the above elastomer (E) is preferably 0.6 to 1.7 from the viewpoint of the spinning property or the like.

On the other hand, the polyester (P) may be any of polyethylene terephthalate, polybutylene terephthalate, polyhexamethylene terephthalate, polytrimethylene terephthalate, polycyclohexylene dimethylene terephthalate, polypivalolactone or a copolymer thereof or the like; however, the polytrimethylene terephthalate-based polyester, the polybutylene terephthalate-based polyester or the polycyclohexylene dimethylene terephthalate-based polyester is preferred from the viewpoint of the elastic recovery property of the resulting fiber structure.

The above polyester (P) preferably has a higher melting point than that of the above polyester-based elastomer (E) by 10° C. or more. The same various copolymerization components as the polyester constituting the hard segment component in the above polyetherester-based block copolymer can be copolymerized if the requirements are satisfied.

The above thermoplastic polyester-based elastomer (E) is preferably conjugated with the polyester (P) in the heat-bonding conjugated fibers of this invention so as to provide an area ratio of E:P of 20:80 to 80:20 in the fiber cross section as described above. At this time, the conjugated state of both the components E and P may be any of known conjugated states such as the eccentric core-sheath type, the side-by-side type, the island-in-sea type conjugated spun fibers or the island-in-sea type incorporated fibers or the tangerine segment type arranged (divided) fibers in addition to the core-sheath type; however, both the components E and P are preferably arranged so that a part of said elastomer (E) is exposed to the fiber surface and 30% or more of the circumference of the fiber cross section is preferably occupied by said elastomer therein. Above all, in the case of the side-by-side type and the eccentric core-sheath type, latent crimpability so as to readily actualize fine crimps at the time of heat treatment when molding a fiber structure can readily be imparted, and the side-by-side type and the eccentric core-sheath type, therefore, are especially preferred because the entanglement of the mutual fibers can be increased and the adhesion can be improved.

The single fiber fineness of the heat-bonding conjugated fibers of this invention is preferably within the range of 0.5 to 200 dtex, more preferably within the range of 2 to 100 dtex. It is perferable to keep the single fiber fineness within the above range from the viewpoint that the number of heat-bonded spots formed in said fiber structure when carrying out heat-bonding treatment in order to provide the fiber structure becomes moderate, a sufficient strength can be obtained and a sticking phenomenon at the time of producing said heat-bonding conjugated fibers can extremely be suppressed.

Furthermore, the shape of the fiber cross section need not be a perfect circle, and a polygonal shape, a finned shape, a dumpling form or the like may be assumed; however, the perfect circular shape is preferred by considering the case where the staple fibers are formed and passed through the carding step. One or more hollow parts may further be provided.

The heat-bonding conjugated fibers of this invention can be produced by a conventional known method when producing the above heat-bonding conjugated fibers.

The cut length is preferably within the range of 10 to 100 mm, especially preferably within the range of 15 to 95 mm when cutting the above heat-bonding conjugated fibers into the staple, fibers. The carding performance and adhesion of the fiber structure are especially good within the range.

The above heat-bonding conjugated staple fibers may be crimped to an extent so as not to cause problems in the process. At this time, the number of crimps is preferably within the range of 8 to 20 peaks/25 mm, and the crimp ratio is preferably within the range of 6 to 18%.

Known methods can be adopted as a method for producing the fiber structure of this invention from the staple fibers of the crimped polyester fibers and the heat-bonding conjugated staple fibers as described above if the heat-bonded spots can be formed at least partially in contact points of the staple fibers of the crimped polyester fibers with the heat-bonding conjugated staple fibers and/or contact points of the mutual heat-bonding conjugated staple fibers in the interior of said fiber structure by the known methods. For example, methods for blow molding the fibers into a specific mold and then heat-treating the resulting molded fibers, methods for blowing fiber balls into a specific mold while heat-treating the fibers with hot air or the like and forming the fiber balls, further, as necessary, carrying out heat treatment again and molding the structure or the like can preferably be adopted.

The temperature and time for melting only the thermoplastic polyester-based elastomer (E) may be adopted as heat-treating conditions at the time of the above molding. Specifically, the heat-treating temperature is preferably about 100 to 210° C., and the heat-treating time is preferably about 10 to 30 minutes.

Examples and the like are cited hereinafter in order to make the constitution and effects of this invention more concrete; however, these examples are not intended to limit this invention at all. Respective values in the examples were determined in accordance with the following methods:

1) Intrinsic viscosity

A polyethylene terephthalate (PET) and a polytrimethylene terephthalate (PTT) were dissolved in an o-chlorophenol solution at 1.2 g/dl, and a polybutylene terephthalate (PBT) was dissolved in the o-chlorophenol solution at 0.8 g/dl to respectively determine the intrinsic viscosities at 35° C. in accordance with a conventional method.

2) Fineness, fiber length, number of crimps, percentage crimp and crimp modulus of elasticity Measurements were made in accordance with the method defined in JIS-L1015.

3) Specific volume, compressibility and recovery ratio

The resulting staple fibers were passed through a card to prepare a web, and measurements were made in accordance with the method defined in JIS-L1097.

4) Carding performance

Fibers were carded under conditions so as to provide a surface speed of a doffer of 35 m/min and a basis weight of the spun web of 50 g/m$^2$, and the carding performance when operating the card for 1 hour was evaluated to indicate the results by good, poor and bad.

Evaluation of Fiber Structure

5) Hardness (elasticity)

Measurements were made in accordance with the method define in JIS-K6401 (5.4). A value of 130 to 200 N was good.

6) Repeated compression residual strain (durability)

Measurements were made in accordance with the method described in JIS-K6401 (5.6). A value of 10% or below was good.

7) Unevenness of hardness

Ten experts were randomly selected, and organoleptic evaluations of unevenness of hardness and softness by touching the surface of each fiber structure with hands were made on the basis of the following criteria:

5: Excellent (extremely uniform without recognized unevenness)

4: Fair (mostly uniform with hardly any unevenness)

3: Good (no anxiety in spite of partially present unevenness)

2: Poor (recognized unevenness)

1: Extremely bad (distinctly many unevennesses)

EXAMPLE 1

A polytrimethylene terephthalate (having an intrinsic viscosity of 0.85 and a melting point of 225° C.) was used, melted at 260° C. and discharged from a known spinneret having a hollow circular cross section (150 holes) at a throughput of 480 g/min, and quench air at 25° C. was blown from one side of the resulting filaments at right angles from the forward direction of the filaments thereon at a flow velocity of 1.5 m/s in a position at a distance of 1.5 to 15 cm under the spinneret surface to provide an undrawn yarn at a winding speed of 1,200 m/min. The resulting undrawn yarn was then formed into a tow of 500,000 dtex and subsequently drawn at 2.46 times by a two-stage hot-water drawing method at 70° C.×90° C. The drawn yarn was crimped with a stuffing type crimper, then cut to a fiber length of 64 mm and subjected to heat shrinking treatment at 135° C. under relaxed conditions to afford crimped fibers having a percentage of hollowness of 15% and helical three-dimensional crimps. The resulting crimped fibers were passed through a card to prepare a web, which was formed into a futon wadding. Performances thereof were measured, and Table 1 shows the results.

EXAMPLES 2 TO 4 AND COMPARATIVE EXAMPLES 1 AND 2

A futon wadding was prepared in the same manner as that in Example 1, except that the number of crimps and crimp ratio were changed as shown in Table 1 by regulating the flow velocity of quench air, and performances were measured. Table 1 shows the results.

COMPARATIVE EXAMPLE 3

A polyethylene terephthalate (having an intrinsic viscosity of 0.64 and a melting point of 256° C.) was used, melted at 290° C. and discharged from a known spinneret having a hollow circular cross section (150 holes) to provide filaments, and quench air at 25° C. was then blown from one side of the resulting filaments at right angles from the forward direction of the filaments thereon at a flow velocity of 1.5 m/s in a position at a distance of 1.5 to 15 cm under the spinneret surface to afford an undrawn yarn at a winding speed of 1,200 m/min. The resulting undrawn yarn was formed into a tow having 500,000 dtex and subsequently drawn at 2.40 times by a two-stage hot-water drawing method at 70° C.×90° C. The resulting drawn yarn was crimped with a stuffing type crimper, subsequently cut to a fiber length of 64 mm and subjected to heat shrinking treatment at 135° C. under relaxed conditions to provide crimped fibers having a percentage of hollowness of 15% and helical three-dimensional crimps. The resulting crimped fibers were passed through a card to prepare a web, which was formed into a futon wadding. Performances thereof were measured, and Table 1 shows the results.

COMPARATIVE EXAMPLE 4

A futon wadding was prepared in the same manner as that in Example 1, except that quench air was uniformly blown on the filaments to carry out spinning without performing the asymmetric quenching and an undrawn yarn was obtained. The resulting futon wadding was only two-dimensionally crimped by stuffing crimping without any helical three-dimensional crimp in the futon wadding as in Example 1. Performances of said futon wadding were evaluated, and Table 1 shows the results.

TABLE 1

| | Example | | | | Comparative Example | | | |
|---|---|---|---|---|---|---|---|---|
| | 1 | 2 | 3 | 4 | 1 | 2 | 3 | 4 |
| (1) | PTT | PTT | PTT | PTT | PTT | PTT | PET | PTT |
| (2) | (3) | (3) | (3) | (3) | (3) | (3) | (3) | (4) |
| (5) | 1.5 | 2.0 | 3.0 | 4.0 | 0.5 | 5.0 | 1.5 | 1.5 |
| (6) | 12.5 | 12.2 | 12.0 | 11.8 | 12.0 | 12.2 | 12.2 | 12.0 |
| (7) | 9.2 | 11.5 | 13.3 | 18.5 | 5.2 | 30.5 | 9.4 | 6.3 |
| (8) | 30.5 | 31.3 | *34.5 | 39.4 | 14.8 | 52.0 | 31.2 | 12.4 |
| (9) | 92.3 | 87.5 | 89.1 | 92.4 | 85.6 | 93.0 | 82.4 | 84.1 |
| (10) | 115 | 117 | 109 | 113 | 121 | — | 120 | 128 |
| (11) | 52 | 50 | 57 | 56 | 61 | — | 68 | 66 |
| (12) | 95 | 9.4 | 93 | 94 | 81 | — | 72 | 69 |
| (13) | Good | Good | Good | Good | Poor | Bad | Good | Good |

Notes:
(1) means "Composition".
(2) means "Method for crimping (crimp shape)".
(3) means "Asymmetric quenching (three-dimensional)".
(4) means "Only stuffing crimping (two-dimensional)".
(5) means "Flow velocity of quench air (m/s)".
(6) means "Fineness (dtex)".
(7) means "Number of crimps (peaks/25 mm)".
(8) means "Crimp ratio (%)".
(9) means "Crimp modulus of elasticity (%)".
(10) means "Specific volume (cm$^3$/g)".

TABLE 1-continued

| Example | | | | Comparative Example | | | |
|---|---|---|---|---|---|---|---|
| 1 | 2 | 3 | 4 | 1 | 2 | 3 | 4 |

(11) means "Compressibility (%)".
(12) means "Recovery ratio (%)".
(13) means "Carding performance".

EXAMPLE 5

A reaction vessel equipped with a distillatory apparatus was charged with 75 parts by weight of dimethyl terephthalate, 25 parts by weight of dimethyl isophthalate, 59 parts by weight of tetramethylene glycol, 71 parts by weight of polytetramethylene glycol (having a molecular weight of 1,500) and 0.2 part by weight of tetrabutoxy titanate as a catalyst. Transesterification was carried out at 210° C. in accordance with a conventional method, and polycondensing reaction was subsequently conducted at 240° C. To the resulting product, were added 1 part by weight of Sumilizer GA-80 manufactured by Sumitomo Chemical Co., Ltd. and 1 part by weight of Sumilizer TP-D manufactured by Sumitomo Chemical Co., Ltd. as antioxidants just before completing the polycondensing reaction. The resulting mixture was melt stirred and then formed into chips in accordance with a conventional method to provide a polyetherester block copolymer elastomer containing 40% by weight of a soft segment. The melting point of the thermoplastic elastomer was 130° C., and the intrinsic viscosity thereof was 1.15.

Spinning of the resulting thermoplastic elastomer as a sheath component and a polybutylene terephthalate (PBT having an intrinsic viscosity of 0.85 and a melting point of 232° C.) as a core component was carried out at a throughput of 720 g/min by using a known spinneret for eccentric core-sheath conjugated fibers (260 holes) so as to provide a fiber cross-sectional area ratio of core/sheath=60/40, and the resulting filaments were wound at 1,100 m/min to afford an undrawn yarn. The obtained undrawn yarn was then formed into a tow having 500,000 dtex and subsequently drawn at 4.4 times by a two-stage hot-water drawing method at 70° C.×90° C. The resulting drawn yarn was crimped with a stuffing type crimper, then subjected to heat shrinking treatment at 50° C. under relaxed conditions and subsequently cut to a fiber length of 51 mm to provide heat-bonding conjugated staple fibers. The resulting fibers had a single fiber fineness of 6 dtex, a number of crimps of 11 peaks/25 mm and a crimp ratio of 8%.

The above heat-bonding conjugated staple fibers were mixed with the polytrimethylene terephthalate fibers in Example 1 at a ratio described in Table 2 and then passed through a roller card twice to afford a mixed fiber web, which was placed in a mold form so as to provide a constant density and heat-treated in a circulating hot-air dryer under conditions of 180° C.×15 min to afford a fiber structure having a density of 0.04 g/cm$^3$ and a thickness of 5 cm. The resulting fiber structure was soft and good in hand. Table 2 shows the results obtained by evaluating characteristics of said fiber structure.

EXAMPLES 6 AND 7

A fiber-composite structure was obtained in the same manner as that in Example 5, except that the cross-sectional area ratio of the component E (sheath)/component P (core) in the heat-bonding conjugated fibers or the mixing ratio of the heat-bonding conjugated staple fibers/polytrimethylene terephthalate staple fibers in the fiber structure was changed as shown in Table 2. The results obtained by evaluating characteristics of said fiber structure are shown in Table 2.

EXAMPLE 8

Heat-bonding conjugated staple fibers were obtained under the same production conditions as those in Example 5 by changing the core component (P) of the heat-bonding conjugated fibers from the polybutylene terephthalate into a polyethylene terephthalate (PET having an intrinsic viscosity of 0.64 and a melting point of 256° C.). Said staple fibers had a single fiber fineness of 12 dtex, a number of crimps of 11 peaks/25 mm and a crimp ratio of 9%.

A fiber structure was obtained in the same manner as that in Example 5, except that the above heat-bonding conjugated staple fibers were used in place of the heat-bonding conjugated staple fibers comprising the polybutylene terephthalate as the core component (P) in Example 5. The resulting fiber structure was soft and good in hand. Table 2 shows the results obtained by evaluating characteristics of said fiber structure.

COMPARATIVE EXAMPLE 5

A fiber-composite structure was obtained in the same manner as that in Example 5, except that the polyethylene terephthalate staple fibers in Comparative Example 3 were used in place of the polytrimethylene terephthalate staple fibers in Example 5. The resulting fiber structure had a somewhat harder hand than that in Example 5. Table 2 shows the results obtained by evaluating characteristics of said fiber structure.

TABLE 2

| | | | | Example | | | | (1) |
|---|---|---|---|---|---|---|---|---|
| | | | Units | 5 | 6 | 7 | 8 | 5 |
| (2) | (3) | TA | mole % | 75 | 75 | 75 | 75 | 75 |
| | | IA | mole % | 25 | 25 | 25 | 25 | 25 |
| | | TMG | mole % | 100 | 100 | 100 | 100 | 100 |
| | | (4) | mole % | 1500 | 1500 | 1500 | 1500 | 1500 |
| | | (5) | wt. % | 40 | 40 | 40 | 40 | 40 |
| | | (6) | ° C. | 1500 | 155 | 155 | 155 | 155 |
| | (7) | Polymer | | PBT | PBT | PBT | PBT | PBT |
| | (6) | ° C. | 232 | 232 | 232 | 256 | 236 | |
| | (8) | | | 40/60 | 70/30 | 40/60 | 40/60 | 40/60 |
| | (9) | | | Good | Good | Good | Good | Good |
| (10) | | | | PTT | PTT | PTT | PTT | PET |
| (11) | | | | 70/30 | 70/30 | 50/50 | 70/30 | 70/30 |
| (12) | | Hardness | N | 161 | 153 | 160 | 174 | 209 |
| | (13) | | % | 7.1 | 6.4 | 6.9 | 9.3 | 11.1 |

TABLE 2-continued

| | | Example | | | | (1) |
|---|---|---|---|---|---|---|
| | Units | 5 | 6 | 7 | 8 | 5 |
| (14) | Grade | 5 | 5 | 5 | 5 | 4 |

Notes:
(1) means "Comparative Example".
(2) means "Heat-bonding fiber".
(3) means "Component (E)".
(4) means "Molecular weight of PTMG".
(5) means "Copolymenzation ratio of PTMG".
(6) means "Melting point".
(7) means "Component (P)".
(8) means "Cross-sectional area ratio of (E)/(P)".
(9) means "Spinning performance".
(10) means "Crimped polyester fiber".
(11) means "Weight ratio of crimped polyester fiber/heat-bonding fiber".
(12) means "Characteristic of fiber structure".
(13) means "Repeated compression residual strain".
(14) means "Unevenness of hardness"

POSSIBILITY OF INDUSTRIAL UTILIZATION

The crimped polyester fibers of this invention comprise a polytrimethylene terephthalate-based polyester and have three-dimensional crimps well balanced in number of crimps, crimp ratio and crimp modulus of elasticity. Therefore, by the synergistic effects, the carding performance is improved, and compression durability and bulkiness of products obtained from said fibers are remarkably improved. Accordingly, said polyester fibers can especially suitably be used in applications such as nonwoven fabrics, waddings or cushioning materials. In particular, the fiber structure of this invention using the above crimped polyester fibers sufficiently exhibits performances of said crimped polyester fibers and is excellent in bulkiness and compression durability. Thus, the fiber structure can suitably be used as beddings, furniture, vehicular materials (cushioning materials, ceiling materials or protective materials), clothes, filter materials, building/civil engineering materials, agricultural materials and the like and has a high value of industrial utilization.

What is claimed is:

1. Crimped polyester fibers characterized as comprising a polytrimethylene terephthalate-based polyester and having three-dimensional crimps with a number of crimps of 9 to 30 peaks/25 mm and a crimp ratio of 20 to 50% and further a crimp modulus of elasticity of 80% or above.

2. The crimped polyester fibers according to claim 1, wherein the crimped polyester fibers are hollow fibers having a percentage of hollowness of 5 to 80%.

3. A fiber structure characterized as comprising staple fibers of the crimped polyester fibers according to claim 1 and heat-bonding conjugated staple fibers in a weight ratio of the staple fibers of said crimped polyester fibers to said heat-bonding conjugated staple fibers of 30:70 to 95:5 and having heat-bonded spots formed at least partially in contact points of the staple fibers of said crimped polyester fibers with said heat-bonding conjugated staple fibers and/or contact points of the mutual heat-bonding conjugated staple fibers.

4. The fiber structure according to claim 3, wherein the heat-bonding conjugated staple fibers are polyester-based conjugated fibers prepared by arranging a thermoplastic polyester-based elastomer (E) and a polyester (P) having a higher melting point than that of said elastomer by 10° C. or more in an area ratio of E:P=20:80 to 80:20 in the fiber cross section so as to expose at least a part of said elastomer (E) to the fiber surface.

5. The fiber structure according to claim 4, wherein the thermoplastic polyester-based elastomer (E) is a polyetherester-based block copolymer comprising a hard segment component and a soft segment component in a copolymerization ratio (weight ratio) of the hard segment component to the soft segment component of 95:5 to 20:80 and said hard segment component is a polyester comprising a main acid component of 40 to 100 mole % of terephthalic acid and 0 to 50 mole % of isophthalic acid and a main glycol component of 1,4-butanediol and said soft segment component is a poly(alkylene oxide)glycol having an average molecular weight of 400 to 5,000.

* * * * *